United States Patent [19]

Jubinville

[11] 4,288,036

[45] Sep. 8, 1981

[54] SPRAY GUN

[76] Inventor: Roland C. Jubinville, P.O. Box 150, Millet, Alberta, Canada, T0C 1Z0

[21] Appl. No.: 85,552

[22] Filed: Oct. 17, 1979

[51] Int. Cl.[3] ..... B05B 7/14

[52] U.S. Cl. ..... 239/345; 239/346; 239/353; 239/414; 239/419.3; 239/424.5; 239/527

[58] Field of Search ..... 239/325, 345, 346, 353, 239/379, 414, 419, 419.3, 422, 424, 424.5, 526, 527; 51/427, 438, 439

[56] References Cited

U.S. PATENT DOCUMENTS

| | | | |
|---|---|---|---|
| 2,255,189 | 9/1941 | Robinson et al. | 239/414 |
| 3,790,030 | 2/1974 | Ives | 239/414 X |
| 3,799,438 | 3/1974 | Shockley | 239/424 X |
| 3,892,360 | 7/1975 | Schlottmann et al. | 239/345 |
| 4,123,007 | 10/1978 | Gardner | 239/414 |

FOREIGN PATENT DOCUMENTS

| | | |
|---|---|---|
| 462121 | 12/1949 | Canada . |
| 710284 | 5/1965 | Canada . |
| 836450 | 3/1970 | Canada . |
| 932594 | 8/1973 | Canada . |

*Primary Examiner*—Andres Kashnikow
*Attorney, Agent, or Firm*—Rogers, Bereskin & Parr

[57] ABSTRACT

A spray gun is disclosed for simultaneously spraying a liquid and a particulate material, for example, in applying decorative facings to walls and like surfaces. The gun is designed to spray a central stream of particulate material surrounded by a liquid stream. The gun includes a first air passageway into which the particulate material is introduced and a second air passageway into which liquid can be introduced under pressure. An air flow control valve is disposed in a first air passageway and is coupled to a trigger so that the valve is progressively opened as the trigger is squeezed. A flow control valve is also provided for the liquid and is coupled to the trigger so as to be progressively opened as the trigger is squeezed.

8 Claims, 8 Drawing Figures

SPRAY GUN

This invention relates to a spray gun for simultaneously spraying a liquid and a particulate material such as dyed sand, for example in applying decorative facings to walls and like surfaces.

According to the invention the gun includes a body defining a handle section and a nozzle assembly coupled to the body and having a central opening for the discharge of a stream of said particulate material and liquid discharge menas disposed around said opening for the discharge of liquid around said stream of particulate material. The body includes a first air passageway adapted to be supplied with pressurized air and coupled to said central opening of the nozzle assembly. A second air passageway is also provided and is adapted to be supplied with pressurized air and is coupled to said liquid discharge means of the nozzle assembly. First liquid inlet means is provided for the introduction of said particulate material into the first air passageway. Second inlet means is also provided, through which said liquid can be introduced under pressure into the second air passageway and the body also includes means for controlling the introduction of said particulate material into the first air passageway. The gun has a trigger mounted on the body adjacent the handle section for progressive movement with respect to said body from a rest position, the trigger being positioned so that it can be squeezed towards said handle section by a person holding the gun by said section. Spring means is provided normally biassing the trigger to its said rest position. An air flow control valve is disposed in the first air passageway and is coupled to the trigger so that the valve is progressively opened as the trigger is squeezed. The second inlet means includes a liquid flow control valve coupled to the trigger so as to be progressively opened as the trigger is squeezed. This allows the volume of liquid and the amount of particulate material issuing from the gun to be simultaneously varied in use by operation of the trigger.

The invention will be better understood by reference to the accompanying drawings which illustrate various embodiments of the invention by way of example. In the drawings.

Figure 1:
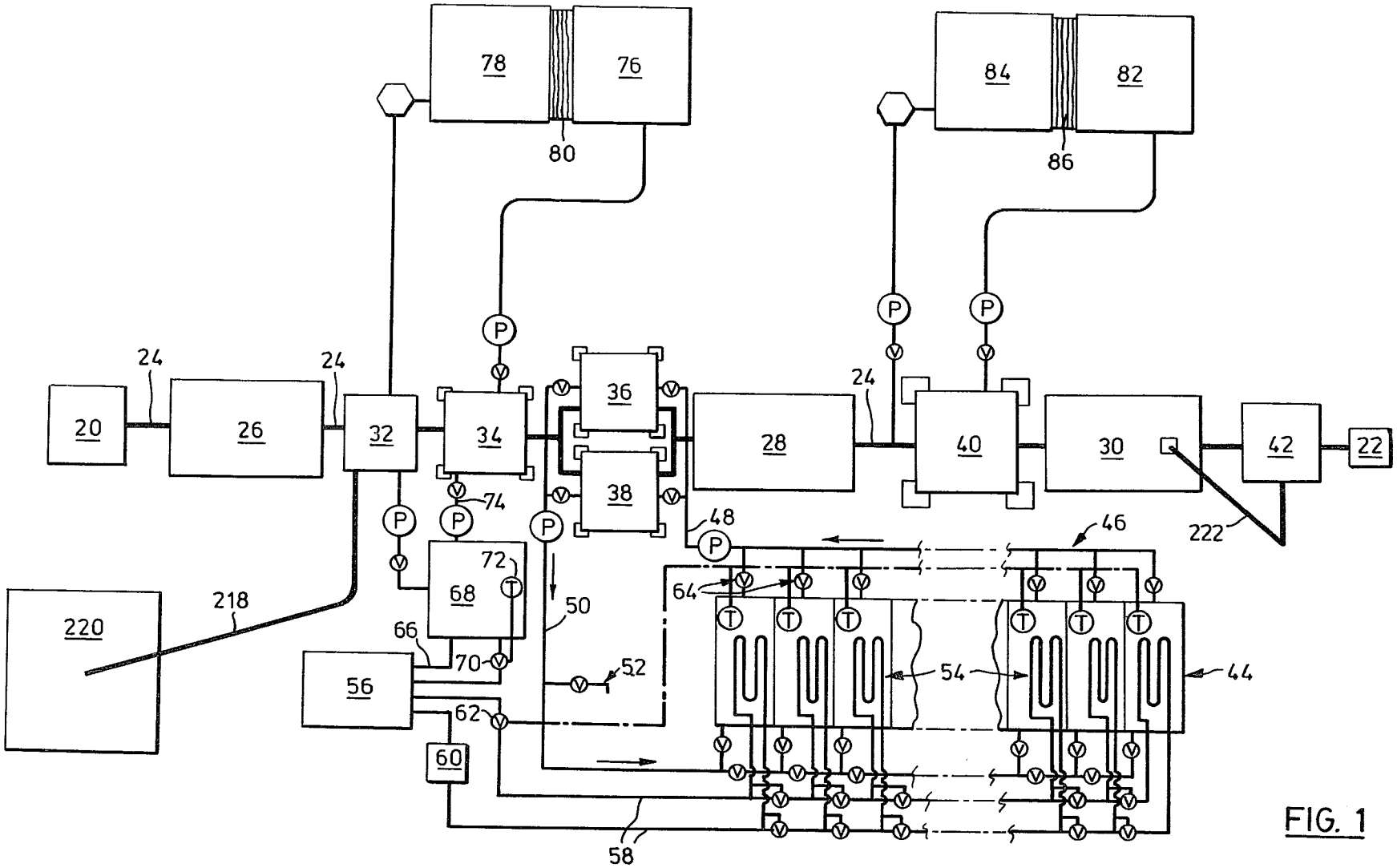
FIG. 1 is a schematic plan view of a sand dyeing installation for performing the process according to the invention.
Figure 5:
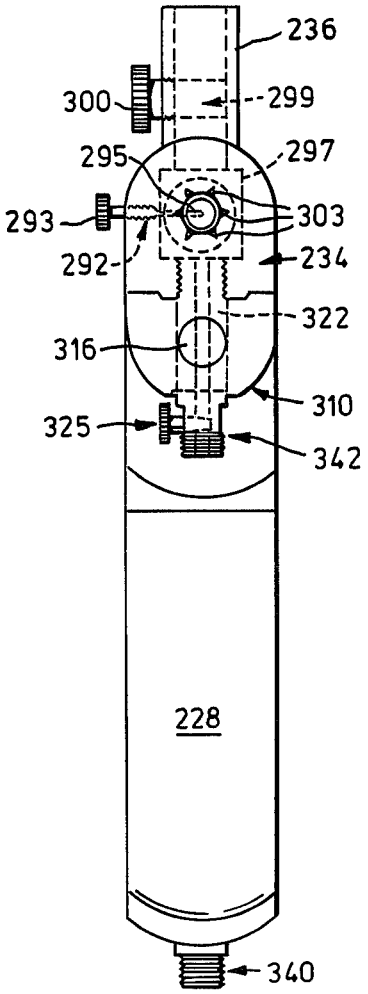
Figure 2:
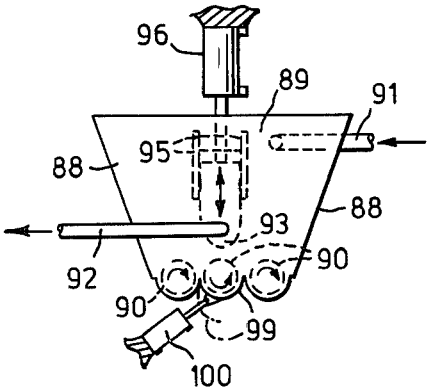
FIG. 2 is an end view of a typical one of the tanks in the installation of FIG. 1.
Figure 2A:
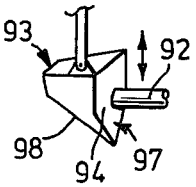
Figures 3, 3A:
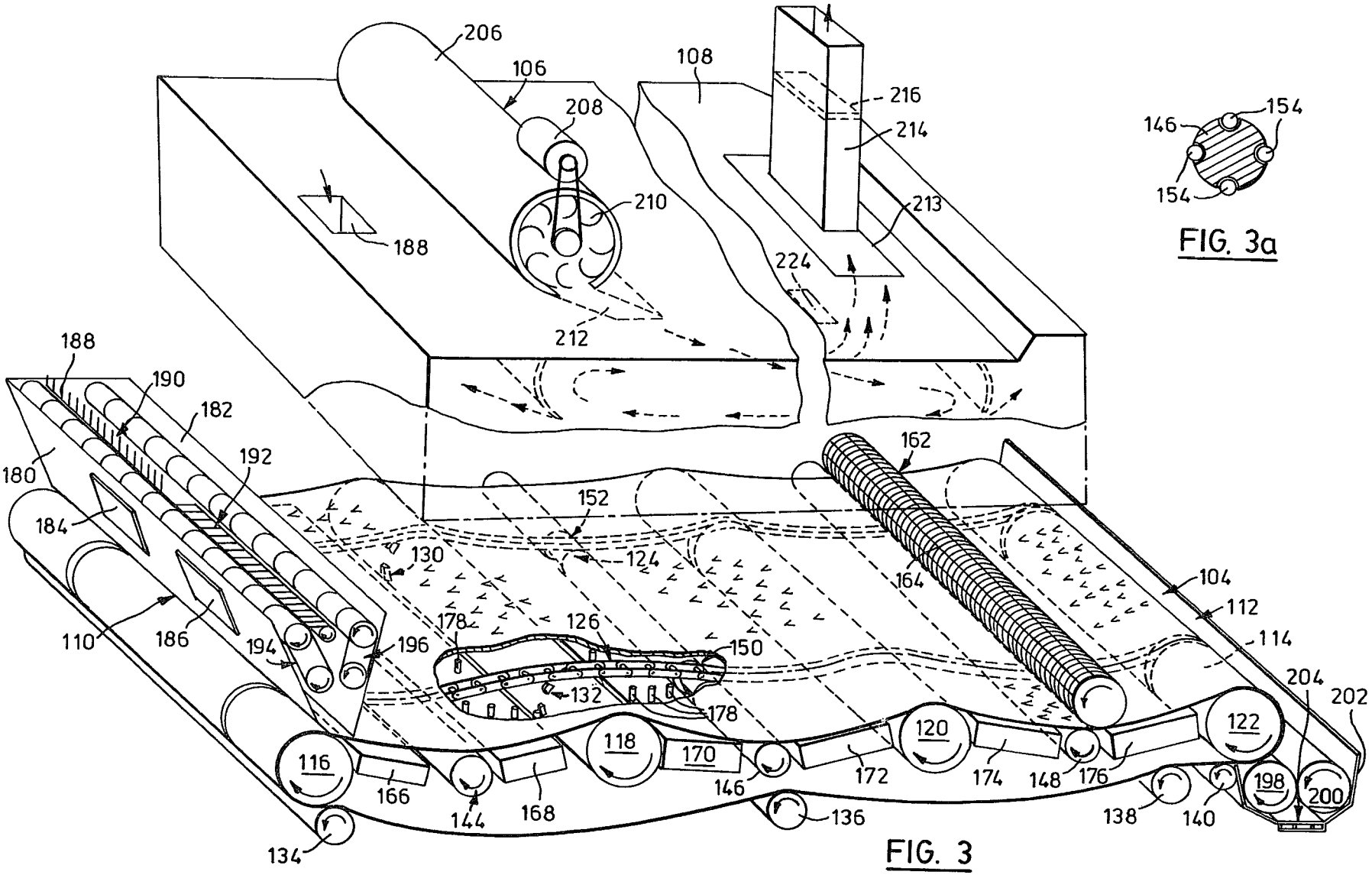
Figure 4:
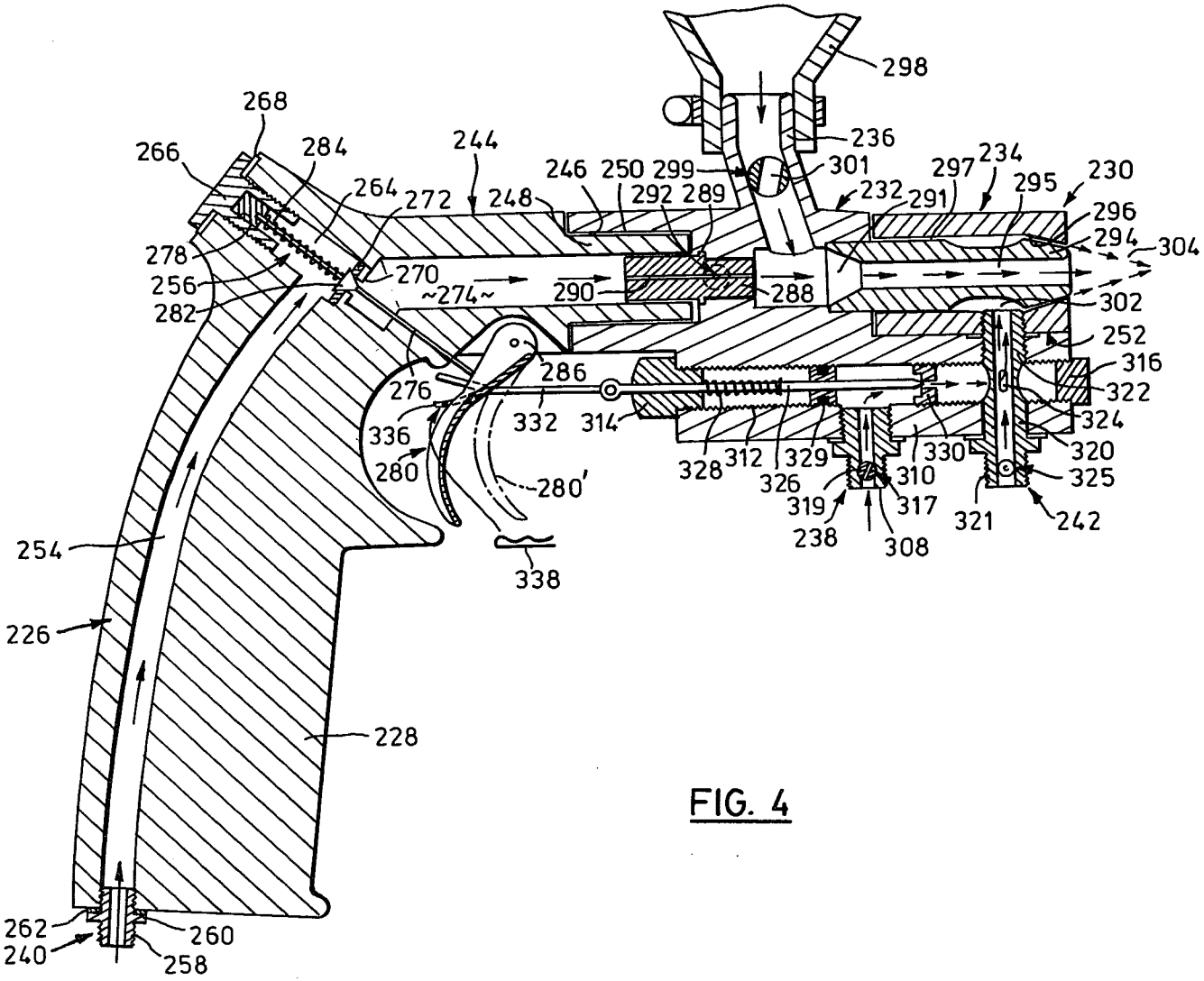
Figure 6:
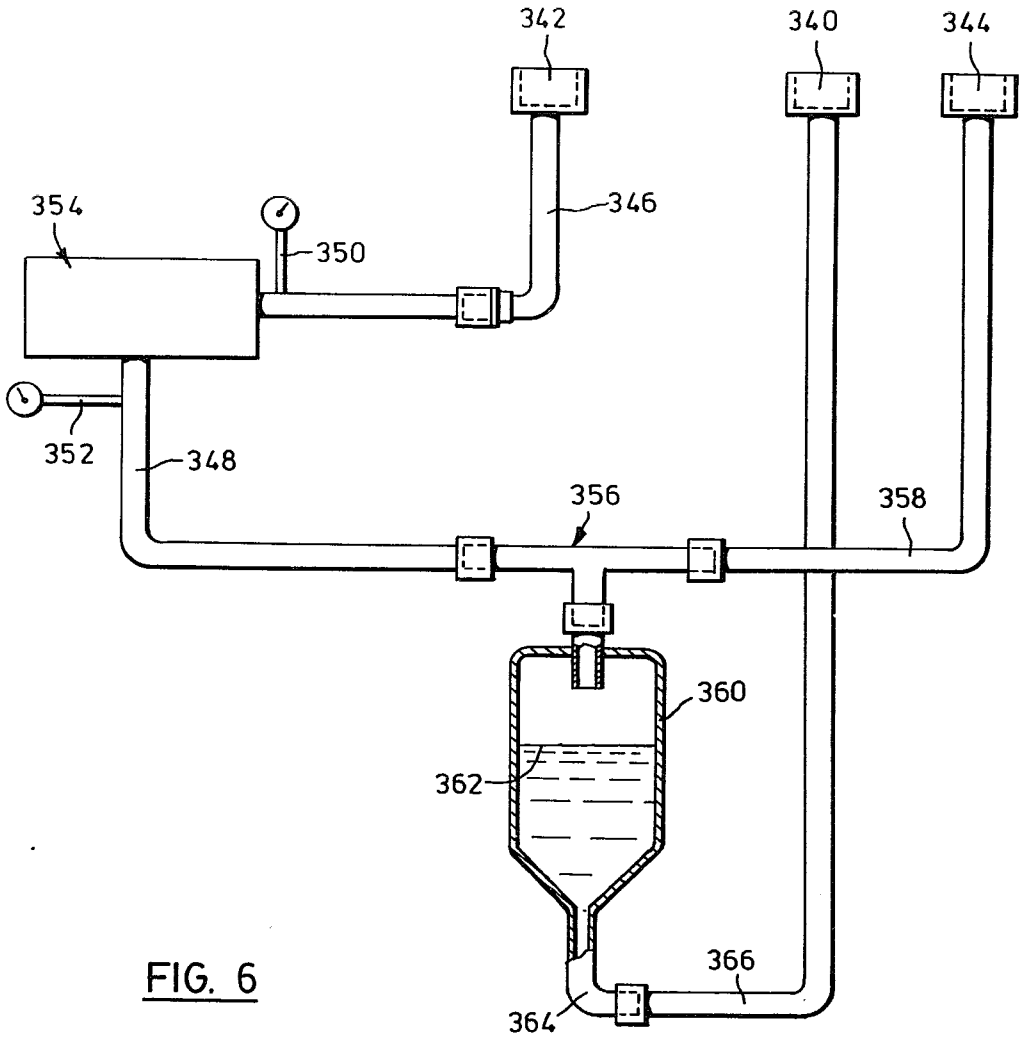

FIG. 2*a* is a detail perspective view of part of FIG. 2;

FIG. 3 is an exploded diagrammatic perspective view of one of the ovens of FIG. 1;

FIG. 3*a* is a detail view of part of FIG. 3;

FIG. 4 is a vertical sectional view through a spray gun which may be used to apply to a surface dyed sand produced in the installation of FIG. 1;

FIG. 5 (which appears on the same sheet as FIGS. 2 and 2*a*) is a front view of the spray gun of FIG. 4; and, FIG. 6 is a diagrammatic illustration of a paint and air supply system for the spray gun of FIGS. 4 and 5.

The invention has been devised primarily in connection with the dyeing of waste sands (called tailings) derived from the Athabasca Tar Sands project in Alberta. It is however to be understood that the method may be used to dye other sands.

Typical samples of tailings used in the method of the invention have the following characteristics.

TABLE 1

Mechanical Analysis of Oil Sand Tailings Fort McMurray Region

| Sample No. | 8 (2.38)[1] | 12 (1.68) | 16 (1.19) | 20 (0.841) | 30 (0.595) | 40 (0.420) | 50 (0.297) | 70 (0.210) | 100 (0.149) | 140 (0.105) | 200 (0.074) | Silt % | Clay % −5 | Tar % |
|---|---|---|---|---|---|---|---|---|---|---|---|---|---|---|
| | U.S. Standard Sieve No. (percent retained) | | | | | | | | | | | | | |
| 1 | 0.22 | 0.11 | 0.41 | 0.99 | 1.81 | 2.15 | 3.54 | 13.36 | 44.17 | 21.30 | 7.78 | 3.64 | 0.52 | 0.15 |
| 2 | | 0.01 | 0.05 | 0.16 | 0.80 | 2.07 | 5.11 | 15.24 | 41.51 | 21.25 | 8.48 | 4.22 | 1.10 | 0.10 |
| 3 | | | 0.01 | 0.01 | 0.03 | 0.05 | 0.09 | 0.68 | 47.58 | 35.49 | 12.40 | 2.67 | 0.99 | 0.16 |

[1]Screen size (mm) corresponding to mesh no.

TABLE 2

Shape, Mineral Composition and Staining of Oil Sand Tailings Fort McMurray Area

| Sample No. | Shape (%) Angular | Sub-rounded | Rounded | Spherical | Mineral Composition (%) Quartz | Feldspars | Chert | Mica | Others | Iron Staining (%) Heavy | Medium | Light | Inclusions | Clean |
|---|---|---|---|---|---|---|---|---|---|---|---|---|---|---|
| 4 | 35 | 56 | 8 | 1 | 95 | 2 | 2 | 1 | | | 12 | 58 | | 30 |
| 5 | 64 | 35 | 1 | | 96 | 2 | 2 | | | 1 | 13 | 35 | | 51 |
| 6 | 38 | 60 | 2 | | 96 | 1 | | 1 | 2 | | 25 | 42 | | 33 |

Referring now to FIG. 1, the various components of a sand dyeing installation are indicated in diagrammatic form. The installation includes a sand pit 20 which contains sand to be dyed. Successive batches of sand are conveyed from the sand pit 20 through various treatment stations to be described, to a bagging plant 22 located at the end of the installation remote from the sand pit 20. The successive batches of sand are conveyed from the sand pit to the bagging plant by a conveyor device comprising a series of individual conveyor sections 24 arranged between the respective components of the installation and arranged to convey the batches generally in a rectilinear direction from the sand pit 20 to the bagging plant 22. Each section is in the form of a conventional belt conveyor.

Arranged at spaced intervals along the conveyor path are three ovens 26, 28, and 30. A typical example of one of these ovens is illustrated in FIG. 3 and will be more specifically described later. The first oven 26 is positioned adjacent to and spaced from the sand pit 20. A screening plant 32 is positioned downstream of the oven 26 in the direction of sand travel. From the screening plant 32 the sand passes to a first washing tank 34 and from there to one of two dyeing tanks 36, 38. The second oven 28 is positioned downstream of the two tanks 36, 38. Positioned intermediate the second oven 28 and the third oven 30 is a second washing tank 40. A final screening plant 42 is positioned downstream of the third oven 30 and in advance of the bagging plant 22.

The components described above form the main treatment stations of the installation. Associated with the main components are a number of auxiliary components which will now be described. These auxiliary components include a series of fifteen separate dye holding tanks generally indicated at 44. The tanks contain batches of dye solutions having respectively different characteristics. For example, the tanks may contain dye solutions have respectively different colours or shades of colour. The tanks 44 have individual outlet pipes generally indicated at 46 which are connected to a common line 48 coupled to both dyeing tanks 36, 38. A common return line 50 extends from both dyeing tanks 36, 38 and is coupled to each of the dye holding tanks 44 by suitable valves.

It will be convenient at this stage to note that the various valves used in installation are generally denoted by the letter v. The valves are conventional liquid flow control valves and may be manually or automatically operated. Similarly, the various pumps employed in the installation are denoted by the letter P. The pumps are also conventional pumps used for conveying liquids.

Referring to the dye holding tanks 44, it will be appreciated that the valving arrangement is such that an individual tank or group of tanks can be coupled to either or both of the dyeing tanks 36, 38. Also, unused dye solution can be returned from one or both of the dyeing tanks to the relevant dye holding tank or group of tanks. The dye return line 50 is also provided with a drain 52 through which waste dye solution can be removed from the return line if necessary.

Each of the dye holding tanks 44 is provided with a heating element 54 in the form of a convoluted water pipe arranged inside the tank. These heating elements allow the temperature of the dye solution in each tank to be controlled in accordance with the requirements of the dyeing process. The heating elements 54 are coupled with a hot water boiler 56 by way of flow and return lines 58. It will be noted that the individual tanks are coupled to the lines 58 by valves so that the heating elements 54 can be individually controlled. The return line to the boiler includes an expansion tank 60. The flow line includes a soleniod operated valve 62. Each of the dye holding tanks is fitted with a thermostat 64 coupled with valve 62 such that the valve is shut off and the flow of hot water to the heating elements 54 is terminated when all of the tanks reach a predetermined temperature.

The boiler 56 is also coupled by lines 66 with a hot water tank 68. The relevant line 66 is provided with a solenoid operated valve 70 similar to valve 60 and controlled by a thermostat 72 in tank 68. Tank 68 provides a hot water supply for the washing tank 34 and is coupled to the tank by a line 74. Water leaving the washing tank 34 is delivered to one of two sumps 76, 78 which are separated by a filter 80 consisting of rock, gravel and sand. Water entering the sump 76 from tank 34 passes to sump 78 by way of a filter which removes coarse elements and impurities. Sump 78 is connected to the hot water tank 68. It will be appreciated that the arrangement just described provides a facility for hot washing of sand in the tank 34.

A somewhat similar arrangement is provided in association with the second washing tank 40, but in this case cold water is used. Tank 40 is coupled with two sumps 82, 84 separated by a filter 86.

The washing tanks 34 and 40 and the dyeing tanks 36 and 38 are all of the same general construction. FIG. 2 shows a typical example of one of these tanks. The tank is open topped and is of rectangular shape in plan view having downwardly and inwardly inclined opposite sides 88 and upright end walls 89 (only one of which is visible). Rotatably mounted in the bottom of the tank are three spiral screws 90. As can be seen the tank bottom is shaped to define semicircular troughs in which the screws rotate. The screws are continuously driven in rotation by motors (not shown) in the directions indicated by the arrows. It will be noted that the two outer screws rotate in the same direction whereas the centre screw rotates in the opposite direction. These screws serve to mix the contents of the tank during the dyeing process.

The tank is provided with liquid inlet and outlet pipes denoted respectively 91 and 92. Valves control liquid flow to and from the tank through these pipes, although these valves are not shown in FIG. 2. The inlet pipe 91 opens into the wall of the tank which is shown at the far end in FIG. 2. The outlet pipe 92 opens into the opposite end wall 89 adjacent the lower end of the wall. FIG. 2*a* shows the inner end of this pipe. The pipe is fitted with a filter (not shown) to restrict entry of sand. Liquid entry is controlled by a valve member 93 having a front face 94 which is positioned across the open inner end of pipe 92 when the valve member is in the closed position in which it is shown in FIG. 2*a*.

Referring back to FIG. 2, valve member 93 is vertically movable between guide plates 95 from the closed position in which it is shown, to an upper position clear of the pipe 92; in this position liquid can enter the pipe. Vertical movement of the valve member is effected by a pneumatic piston and cylinder unit 96. Air is delivered to the unit from a conventional air pressure source. Admission of air to the unit and exhaust of air therefrom is controlled by conventional manually operable pneumatic valves (not shown).

It will be noted that the lower portion 97 of the valve member 93 is of inverted, generally triangular shape in end view and has a lower edge 98 which is inclined upwardly away from face 94. When sand is present in the tank and the valve member 93 is in its closed position, the lower portion of the valve member produces in the sand, a molded depression, the bottom of which is downwardly inclined generally towards the outlet pipe 92. Accordingly, when the valve member is raised to expose the pipe 92, the depression at least substantially remains and acts as a trough which serves to aid liquid flow into the pipe 92.

Sand is removed from the tank through a "trap door" formed by a hinged section 99 of the bottom of the tank. This section is formed in the part of the trough which receives the centre screw 90. The section is of a length less than that of the screw and is movable between the closed position which it is shown in FIG. 2 and the open position indicated in chain line. Movement of the section 99 between its open and closed positions is controlled by a pneumatic piston cylinder unit 100 mounted adjacent the tank. As in the case of piston cylinder unit 96, unit 100 is supplied with air from a conventional source and is controlled by manually operable pneumatic valves (not shown). Of course, either of the pneumatic piston and cylinder units could be replaced by hydraulic units in other embodiments of the invention.

In use, liquid (water in the case of the washing tank 38 and 40, and die solution in the case of the dyeing tank 36 and 38) enters the tank through inlet pipe 91. Sand is then delivered into the tank by the relevant conveyor section 24. The screws serve to agitate the sand and ensure thorough mixing with the liquid. The valve member 93 is of course in the closed position at this time. When the sand and liquid are to be separated, the valve member 93 is raised to its upper position, exposing the pipe 92 and allowing the liquid to drain from the tank. The valve in the liquid inlet pipe 91 is of course closed at this time. When all the liquid has been drained from the tank, the hinged section 99 of the tank bottom is moved to its open position and the screws 90 are operated to discharge the sand from the tank. The tank is positioned directly above the relevant one of the conveyor sections 24 so that the discharged sand falls directly onto the conveyor.

Reference will now be made to FIG. 3 which schematically illustrates one of the ovens 28 and 30 of FIG. 1. The first oven 26 is also of basically similar form; its construction will also become apparent from the following description of FIG. 3. It should be noted that, for clarity of illustration, the base of the oven and the support and drive structures for various components have not been illustrated.

The oven shown in FIG. 3 includes a belt conveyor generally indicated at 104, having a belt made of a woven metal mesh. The belt is heated by gas flames. Air is blown over the sand on the conveyor by a blower generally indicated at 106 fitted to the oven housing 108. Sand is delivered to the end of the conveyor 104 which is shown at the left in FIG. 3 by way of a delivery device 110 and leaves the oven by way of a rubber roller crusher 112 adjacent the opposite end of the belt conveyor. The first oven 26 of FIG. 1 differs from the oven shown in FIG. 3 only in that oven 26 has no rubber roller crusher 112; otherwise, the oven 26 is as shown in FIG. 3.

Belt 114 of the conveyor 104 travels around four rollers 116, 118, 120 and 122 which are mounted to rotate about parallel longitudinal axes. All four rollers are simultaneously driven in the same direction from a common shaft by individual worm and wheel drives (not shown). Considering the oven from the position of FIG. 3, the rollers 116 to 122 rotate clockwise. Welded to the inner surface of the belt are two parallel endless chains 124, 126 which are spaced transversely of the belt. Each roller 116 to 122 has two series of peripheral teeth which engage with the respective chains 124, 126 for driving the belt. Two of these series of teeth are indicated at 130 and 132 in association with roller 118 although it is to be understood that all four rollers have similar teeth. The lower run of the belt 114 is supported by a series of idler rollers 134, 136, 138. In addition, an adjustible roller 140 is provided adjacent the roller crusher 112 for the purpose of adjusting the tension in the belt.

Three rollers 144, 146, 148 are positioned below and in contact with the upper run of the belt 114 intermediate the rollers 116 to 122 for vibrating the belt. Each roller 144, 146, 148 has reduced diameter portions at the positions of the chains 124 and 126. The reduced diameter portions of roller 146 are indicated at 150 and 152; similar portions are provided on the other two rollers. Each vibrator roller 144, 146 and 148 is provided with three longitudinally spaced series of rods. Each series includes four such rods circumferentially spaced around the roller. FIG. 3*a* is a vertical sectional view through roller 146 and shows the rods (154) in one of these series. For convenience of illustration, neither the rods 154 nor the corresponding rods of rollers 144 and 148 are shown in FIG. 3. The rods 154 are of cylindrical shape and are mounted in recesses in the roller surface so as to be individually rotatable about axes parallel to the axis of the roller. The rods protrude from the surface of the roller so that, when the roller rotates, the rods move successively into contact with the undersurface of the belt; since the surface portions of the roller between the rods are lower than the rods, this causes the belt to vibrate. The vibrator rollers 144, 146 and 148 are driven from a common drive shaft by individual worm devices (not shown). The worm drives are arranged so that the frequency of vibration imparted to the belt increases from roller 144 to roller 148 whereby sand on the belt is subject to progressively greater vibration as it approaches the roller crusher 112.

Associated with vibrator roller 148 is a screen crusher in the form of a roller 162, the curved surface of which is formed by a mesh screen 164. The roller is driven by contact with the belt 114 and rotates about an axis parallel to roller 148. The vibrator rollers 142, 146 and 148 together with the screen crusher 162 serve to spread sand evenly on the surface of the belt and to break up cohesive clumps of sand.

When the oven is in use belt 114 is heated by gas flames which play on the undersurface of the upper run of the belt. The flames emanate from gas manifolds 166, 168, 170, 172, 174 and 176 positioned below the upper surface of the belt and connected to a common gas supply (not shown). Each manifold is fitted with an array of upwardly directed gas jets 178. The gas jets produce a temperature in the approximate range 250° to 350° F. when the oven is in use. However, it has been found that the colour the dyed sand can be lightened by increasing the temperature above this range in oven 28 and/or in oven 30.

The sand supply device 110 includes a pair of inclined side plates 180, 182 which together define a trough. The plates are flexibly mounted and each is fitted with two vibrators such as those indicated at 184, 186 in association with plate 180. Sand is delivered into the centre region of the device 110 through a shute opening 188 in the casing 108. The sand is then spread outwardly from this central location by a screw 188 which extends longitudinally of the device 110. Screw 188 has flight sections 190 and 192 of respectively opposite hand which cause the sand to be distributed longitudinally of the device from the central location at which the sand is delivered to the device. Arranged on respectively opposite sides of the screw 188 are two belt conveyors 194, 196 disposed in a V configuration and having their lower ends closely spaced. Typically the width of the longitudinal opening between the lower ends of the two conveyors 194, 196 would be in the range $\frac{1}{4}$ to $\frac{1}{2}$ inch.

When the device 110 is in use, sand delivered outwardly by the screw 188 falls down between the two belt conveyors 194 and 196 and any clumps of sand are broken up by the action of the conveyors. Smooth downward movement of the sand is ensured by the vibrators on the plates 180 and 182.

The roller crusher 112 at the opposite end of the belt conveyor 104 includes two rubber rollers 198, 200 mounted to rotate in a trough 202. The rollers 198 and 200 are arranged with their axes parallel to the axes of the belt driving rollers 116 to 122 and are continuously driven in opposite directions as indicated by the arrows in FIG. 3. The roller crusher is arranged so that sand leaving the discharge end of the belt conveyor 104 falls generally into the nip between rollers 198 and 200 whereby further spreading of the sand is effected. Trough 202 has a longitudinal discharge opening 204 through which discharged sand falls onto the appropriate conveyor section 24 located below the oven.

As indicated above, the housing 108 of the oven is fitted with an air blower 106. The blower includes a casing 206 which supports a motor 208. The casing is of cylindrical form and is open ended. A centrifugal impeller 210 is positioned in the opening and is driven in rotation by the motor 208 so that air is drawn into the ends of the casing 206. Casing 206 has a tangential outlet 212 arranged inside the casing 108 so that air is directed downwardly from the blower generally towards the upper run of the belt 114 of conveyor 104. Casing 108 has an air outlet 213 adjacent the discharge end of the belt conveyor 104. Outlet 213 communicates with a chimney 214 fitted with an air filter 216.

Preparatory to the commencement of the dyeing process, batches of dye solution are prepared in appropriate ones of the dye holding tanks 44. For example, if only a relatively small amount of sand is to be dyed, it might be necessary to use only a single one of the tanks 44. Alternatively, if a larger production is planned, several of the tanks might be used and may be filled with the same of respectively different coloured dyes.

Any appropriate water soluble dye may be used. Experience has shown that fabric dyes such as TINTEX, RITZ or DYLON (registered trade marks) dyes are eminently suitable for use in the process of the invention. TINTEX powder dye has been found to be particularly effective. Whichever dye is selected, it is preferably used at approximately double the strength recommended for dyeing fabrics.

The prepared batches of dye in the relevant ones of the dye holding tanks 44 are then heated to approximately 200° F. by means of a boiler 56. The thermostats 64 in the dye holding tanks 44 are adjusted to approximately this level. Similarly, the water in the hot water tank 68 is held at approximately 200° F. by thermostat 72. It will be recalled that this water is used in the first washing tank 34. The water for the second washing tank 40 is contained in the sumps 82 and 84 and is at approximately room temperature. Accordingly, a substantial temperature differential exists between the hot water used in tank 34 and the cold water used in tank 40.

The dyeing process can now proceed by transporting a first batch of sand from the sand pit 20 to the first oven 26. In passing through this oven, the sand is dried and substantially uniformly distributed across the belt conveyor in the oven. Drying takes place at a temperature in the approximate range of 250°–350° F. Passage of the sand through the oven may also assist in removing from the sand impurities such as tar. On leaving the oven, the sand is conveyed to the screening plant 32. This plant has not been specifically illustrated in the drawings since it is a conventional installation for screening particulate material. The plant is arranged to remove material exceeding 0.300 mm in a diameter. This material is conveyed from the screening plant by a conveyor indicated at 218 and is delivered to a waste material pit 220.

Material passing through the screening plant 32 passes through the first washing tank 44 in which it is washed with hot water (200° F.) to clean the sand. The clean sand then passes to one of the two dyeing tanks 36, 38. Two tanks are provided in order that separate batches of sand may be simultaneously dyed. The batches in the respective tanks may be of the same colour or of respectively different colours. In any event, dye solution at approximately 200° F. is added to the sand in the relevant one of the tanks 36, 38. The sand and dye are agitated together in the tank by the screws in the bottom of the tank (see FIG. 2). The sand and dye are allowed to remain in contact for approximately 1 hour.

At the end of the dyeing period, the dye solution is pumped out of the dyeing tank and the sand is conveyed to the second oven 28. In this oven, the sand is again spread substantially uniformly across the belt conveyor and is vibrated as described in connection with FIG. 3. In passing through oven 28, the sand is thoroughly agitated and dried. The temperature in the oven is in the approximate range 250° to 350° F.

From oven 28, the sand is delivered to the washing tank 40 in which it is continuously washed with cold water from sump 84. The water is normally at ambient (room) temperature. The washing process is visually supervised and is continued until water leaving the washing tank 40 is observed to be substantially clear. The sand is then conveyed to the oven 30 in which it is again spread on a heated conveyor belt. Oven 30 dries the sand. Again, the temperature in the oven is in the approximate range 250° to 350° F.

Finally, on leaving the oven 30, the sand passes to the screening plant 42. This plant is identical to screening plant 32 and acts as a final filter to remove particles larger than 0.300 mm. These particles are returned to oven 30 by way of a conveyor 222 for recycling. In FIG. 3, numeral 224 indicates in chain line an opening provided in the casing of the oven to receive these recycled particles. Screened material leaving plant 42 then passes to a bagging plant 22 of conventional form.

As indicated above, the dyed sand is intended to be used as a decorative facing material, for example, on walls and like surfaces. For this purpose, the sand is mixed with a binding material. An example of a suitable material in polyurethane varnish. Another example is a silicone binding material. The sand may be sprayed onto a surface simultaneously with a polyurethane varnish which will then dry, retaining the sand particles on the surface. The resulting facing is tough, durable and decorative. Commercially available clear polyurethane varnish may be used for this purpose. A typical such varnish is sold under the registered trade mark VARATHANE. An example of another suitable varnish is sold under the trade mark OCEAN FIRE. This varnish has fire retardant properties.

As indicated above, the varnish and sand are preferably simultaneously sprayed onto the surface to be coated. This may be effected by using two spray guns, one for the varnish and one for the sand, or by means of a single spray gun having a facility for simultaneously spraying the varnish and sand. A suitable spray gun is shown in FIGS. 4 and 5 of the drawings. On the other hand, for small scale uses, it would be possible to spray the varnish from an aerosol or like container and manually dispense limited quantities of dyed sand into the varnish stream issuing from the aerosol. In other cases, sand particles could be sprinkled onto a surface coating of a binding material.

Referring now to FIGS. 4 and 5, the spray gun has a body which includes a handle section generally denoted 226 shaped to define a pistol grip 228. The gun also includes a nozzle assembly generally denoted 230, which is fitted to the handle section 226. The nozzle assembly is in fact made in two separable sections denoted respectively 232 and 234. The inner section 232 includes an upwardly directed sand inlet 236 and a downwardly directed liquid inlet 238. The gun has two air inlets, the inlets being denoted respectively 240 and 242. As will be more specifically described later, air introduced through inlet 240 serves to propel sand entering the gun through inlet 236 and air entering through inlet 242 propels liquid entering through inlet 238.

The handle section 226 defines a forwardly directed portion 244, the outer end of which is surrounded by an annular rebate 246 which defines a projecting annular central portion 248. The inner section 232 of the nozzle assembly 230 defines a recess 250 of a shape complimentary to the external shape of portion 248 of the handle section 226. It will be appreciated that section 232 is accordingly separable from section 226. In the assembled gun, the two sections are held together by retaining screws (not shown). The outer section 234 of the nozzle assembly is fitted into a recess 252 in the inner section 232 and is retained in the recess by a part of the air inlet 242, as will be described. Section 234 is visible in front view in FIG. 5.

The handle section 226 is formed with an air passageway which includes a first portion 254 extending through the pistol grip 228 from the air inlet 240 to a valve assembly generally denoted 256. The air inlet 240 includes a fitment 258 which permits an air hose (to be described in connection with FIG. 6) to be coupled to passageway 254. The fitment 258 is in the form of screw threaded sleeve received in a complimentary screw threaded outer end portion of passageway 254. The sleeve has an integral flange 260 by which a sealing ring 262 is trapped against the lower end of the pistol grip 228.

Valve assembly 256 includes a chamber 264 into which passageway 254 opens. Chamber 264 is of cylindrical shape and has an outer end closed by a screw 266 and a sealing washer 268. The inner end of chamber 264 has a central opening 270 fitted with an annular valve seat 272. The opening communicates with a second portion 274 of the air passageway in the handle section 226.

A control rod 276 extends axially of chamber 264 and through the opening 270. Rod 276 has an inner end portion which is received in a recess 278 in screw 266 and an outer portion which projects from the handle section 226 for cooperation with a trigger 280 pivotally mounted on the section. A conical valve member 282 is fitted to rod 276 and is normally biased into engagement with valve seat 272 by a compression spring 284 on the inner end portion of rod 276. Accordingly, the valve member 282 normally closes opening 270. Trigger 280 is formed from sheet metal and defines two lugs 286 (only one of which is visible) pivotally coupled to the handle section 226 of the gun. In the position in which the trigger is shown in FIG. 4, rod 276 bears against the trigger and can therefore be moved against the action of spring 256 by squeezing the trigger. This causes the valve member 282 to lift off the seat 272 and bring passageway 254 into communication with passageway 274.

At its outer end, passageway 274 communicates with a sleeve member 288 fitted in an opening in the inner nozzle section 232. The main part of member 288 is cylindrical but the member also has an integral flange 289 of square shape. This flange is received in a complementary recess in the nozzle section 232 so that the member 288 cannot turn. Member 288 has an axial passageway 290 of small diameter, which communicates inside section 232 with a chamber 291 coupled with the sand inlet 236. As a result of the small diameter of passageway 290, the velocity of air entering chamber 291 when the gun is in use, is increased compared with its velocity in passageway 274. A needle valve 292 (see also FIG. 5) is provided in the nozzle section 232 and can be used to restrict passageway 290 and hence control the air flow along the passageway when the gun is in use. Valve 292 is screw threaded into the nozzle section 232 and has an external head 293 (FIG. 5) by which the valve can be turned to control said air flow in use.

The outer nozzle section 234 includes a sleeve 294 having an axial passageway 295 arranged in alignment with passageway 290. Sleeve 294 is received in an elongate recess 296 in section 234, which recess opens into the outer end of section 234. The outer portion of recess 296 and the corresponding part of sleeve 294 are both of cylindrical cross-section. However, the inner portion 297 of sleeve 294 is square as is corresponding part of recess 296 and the part of the chamber 291 into which sleeve 294 extends. This prevents the sleeve turning inside the nozzle section 234.

Sand is delivered to the inlet 236 from an inverted container 298 which is held in position on the inlet by a ring clamp. The container has an open top for filling purposes and is fitted with a handle (not shown) by which the container can be steadied during spraying. When the gun is in use, sand falls down through inlet 236 into chamber 291 under the action of gravity. The flow of sand can be controlled by a valve 299 turnably mounted in inlet 232 and operable by an external knob 300 (FIG. 5). Valve 299 is formed with a transverse passageway 301 through which the sand flows. High velocity air entering chamber 291 from passageway 274 propels the sand particles along the passageway 295 in sleeve 294 and out of the gun in a stream.

Liquid varnish is delivered to the nozzle assembly 230 and issues from the gun simultaneously with the coloured sand. As will be described, the liquid enters the nozzle assembly from inlet 238. The sleeve 294 of the nozzle assembly is formed with an external annular recess 302 into which liquid droplets pass from inlet 238. Six V-section grooves 303 (see FIG. 5) are formed in the outer portion of the surface of nozzle section 234 which defines recess 296 and extend from the position of the recess 302 to the exterior of section 234. As can be seen from FIG. 5, these passageways are equally spaced around the outer end portion of nozzle sleeve 294. Accordingly, the liquid issues from the nozzle assembly in six fine streams arranged in an annular configuration around the stream of sand issuing from passageway 295. The liquid streams are generally indicated 304 in FIG. 4.

It will of course be appreciated that the outer nozzle section can be replaced by a section having grooves 303 of a different number, size or distribution in order to vary the characteristics of the liquid spray. In fact, nozzle assembly could be designed to provide an annular gap through which the liquid would issue in an annular "curtain" around the steam of sand.

The liquid varnish is delivered to inlet 238 under pressure as will be described in connection with FIG. 6. As in the case of the air inlet 240, inlet 238 includes a fitment 308 in the form of a screw threaded sleeve to which the supply line is coupled. Fitment 308 is screwed into a complimentary screw threaded opening in a depending portion 310 of the inner nozzle section 232. This opening communicates with a longitudinal passageway 312 in the said portion 310. Opposite ends of the passageway are closed by plugs 314 and 316. A valve 317 is provided in the inlet fitment 308 to control the flow of liquid into the gun in use. The valve is in the form of a simple turnable spindle having an external head (hidden in FIG. 5) and formed inside the fitment with a diametral opening 319 which can be aligned with the passage in inlet 308. By turning the spindle head, it is possible to vary the position of the opening 319 in relation to the axis of the fitment 308 and hence control the volume of liquid entering inlet 308 in use.

The second air inlet 242 also communicates with the passageway 312 referred to above. This inlet also includes a sleeve 320 having an outer screw threaded portion 321 by which an air line can be coupled to the inlet in use. The inner portion 322 of sleeve 320 is extended compared with the sleeves of the other inlets and has a screw threaded inner end portion which is received in a complimentary screw threaded opening in the outer nozzle section 234. It will be appreciated that sleeve 320 accordingly serves to retain section 234 in position. It will also be noted that the internal passageway in sleeve 320 communicates with the annular recess 302 of the sleeve 294 of the nozzle assembly. The passageway in sleeve 320 also communicates with passageway 312 by way of openings 324. Inlet 242 is also provided with a needle valve generally denoted 325 similar to the needle valve 392 referred to above. Valve 325 can be used to regulate the air entering the spray gun through inlet 242.

When the gun is in use, air entering inlet 242 flows through sleeve 320 and mixes with liquid entering the sleeve under pressure through openings 324. Delivery of liquid into the air stream in sleeve 320 is controlled by a needle valve in passageway 312. The valve includes a needle 326 which is biased to the right in FIG. 4 by a spring 328 extending between plug 314 and a collar on the needle. An annular seal 329 is provided on the needle to prevent leakage of varnish. When the needle valve is closed, the inner end of the needle fits into the central opening of an annular member 330 positioned inside passageway 312 between inlet 238 and inlet 242. It will be appreciated that some atomization of liquid will occur as the liquid passes through the central opening in member 330 and that further atomization will occur when the liquid meets the air stream in sleeve 320. The outer end of needle 326 is coupled to a rod 332 which extends through an opening 334 in the trigger 280. As can be seen, the outer end portion of rod 332 is bent downwardly to a slight extent as indicated at 336. Two holes are provided at spaced positions along portion 336. A spring clip 338 is intended to be inserted into a selected one of these holes to couple rod 332 to the trigger 280 so that the needle valve can be opened by squeezing the trigger 280.

In the position shown in the drawings, clip 338 is inserted into the hole nearest the outer end of rod 332 so that when the trigger is squeezed both the liquid needle valve 326 and the air control valve 256 will be opened. Accordingly, sand and liquid will be simultaneously delivered through the nozzle of the gun. If the rod 332 is turned to bring its outer end portion 336 to the upwardly directed chain line position indicated in FIG. 4, clip 338 can be inserted into the other of the holes in portion 336, bringing the trigger to the chain line position indicated at 280'. In this position, operation of the trigger will not affect the valve 256 so that liquid only will be delivered to the nozzle. If the gun is to be used for spraying sand only, clip 338 can be removed entirely, in which case valve 256 only will be operated. It will of course be appreciated that it will not normally be necessary to spray sand or liquid alone in applying decorative facings.

FIG. 6 shows the paint and air supply system for the spray gun of FIGS. 4 and 5. It will be remembered that the spray gun has a liquid varnish inlet fitment 238 and two air inlet fitments 240 and 242. In FIG. 6 unions for coupling to said fitments are indicated respectively at 340, 342 and 344. Union 340 is coupled to a supply of liquid varnish under pressure. Unions 342 and 344 are coupled directly to a pressurized air supply.

Numerals 346 and 348 denote pressurized air supply lines controlled by individual pressure regulators 350 and 352 respectively. The pressurized air supply delivered to lines 346 and 348 is derived from a common compressor represented generally by the box denoted 354. Of course, individual compressors could alternatively be used. Air supply line 346 is coupled to the union 342 for the air supply inlet 240. The regulator 350 is arranged to produce an air pressure in the range 40 to 50 p.s.i.

The other air supply line 348 is coupled to one limb of a T-piece denoted 356. Air line 248 is connected to one horizontal limb of the T-piece. The other limb is connected to an air line 358 having at its outer end the union 344 for connection to air inlet fitment 242. The stem of the T-piece 356 is connected to a pressure-tight liquid varnish container 360. The level of liquid in the container is indicated at 362 and it will be noted that the pressure connection from the T-piece 356 is coupled to the container above the level of the liquid. Container 360 has an outlet 364 at its lower end which is coupled to a liquid varnish supply line 366 having said union 340 at its outer end. It will be appreciated that the air pressure in line 348 pressurizes the air above the liquid in container 360 and causes the liquid to be delivered under pressure along line 366 to the spray gun. The air pressure regulator 352 is controlled so that the pressure in each of the lines 358 and 366 is in the region of 40 p.s.i.

The application of decorative facings is effected by simultaneously spraying sand of the required colour and varnish onto the surface to be coated. Conventional spray application techniques are employed in manipulating the gun to produce the required effect. Stencilling, masking and the like expedients may be employed where necessary.

The spray gun of FIGS. 4 and 5 has a significant advantage over conventional multiple nozzle spray guns in that at least partial atomization of the liquid being sprayed takes place inside the spray gun. This avoids or minimizes production of "fog" when spraying. In many conventional spray guns, atomization does not occur until the liquid leaves the spray nozzle with the result that a substantial amount of "fog" is produced and significant quantities of liquid are lost as a consequence.

A further advantage of the spray gun is that because the liquid spray issues in an annular stream around the central sand stream, the stream of sand is enclosed by the liquid stream, which helps to constrain the sand and which also ensures that the sand particles are well coated with varnish by the time they reach the surface to which the sand is being applied.

It will be appreciated that the spray gun may be used not only in the application of decorative surface coatings as described in the present application but also in many other fields. For example, as a result of the facility which the gun has for spraying sand or liquid alone, the gun may also be used for normal spraying operations with paint, varnish and the like and also for spraying particulate materials, e.g. in sand blasting operations.

It is of course to be understood that the preceding description applies to specific embodiments and that many modifications are possible within the broad scope of the invention. In particular, it is to be understood that the process of the invention may be performed in the dyeing installations other than the specific one shown in the drawings. For example, rotary ovens could be used instead of the ovens shown in the drawings. The form of the washing and dyeing tank may also vary. Propeller type mixers may be used in place of or in addition to the screw type mixer shown. With reference to the binding material, although a number of examples have been mentioned above, it is to be understood that they are not exhaustive. For outdoor applications the binding material should enclose the sand particles to protect against colour deterioration due to the effects of the weather.

I claim:

1. A spray gun adapted to simultaneously spray a liquid and a particulate material, the gun comprising:

a body defining a handle section;

a nozzle assembly coupled to said body and having: a central opening for the discharge of a stream of said particulate material; and liquid discharge means disposed around said opening for the discharge of liquid around said stream of particulate material;

said body including: a first air passageway having an inlet end, and an outlet end communicating with said central opening of the nozzle assembly; means at said inlet end for coupling a source of pressurized air to said first air passageway; a second air passageway having an inlet end, and an outlet end coupled to said liquid discharge means of the nozzle assembly; means at said inlet end for coupling a source of pressurized air to said second air passageway; first inlet means disposed intermediate said inlet and outlet of said first air passageway and through which said particulate material can be introduced into said first air passageway; second inlet means disposed intermediate said inlet and outlet of said second air passageway and through which said liquid can be introduced under pressure into said second air passageway; and means in said first inlet means for controlling the introduction of said particulate material into said first air passageway;

a trigger mounted on said body adjacent said handle section for progressive movement with respect to said body from a rest position, said trigger being positioned so that it can be squeezed towards said handle section by a person holding the gun by said section;

spring means normally biassing said trigger to its said rest position; and, an air flow control valve disposed in said first air passageway upstream of said first inlet means and coupled to said trigger so that the valve is progressively opened as the trigger is squeezed;

said second inlet means including a liquid flow control valve coupled to said trigger so as to be progressively opened as the trigger is squeezed;

whereby the volume of liquid and the amount of particulate material issuing from the gun can be simultaneously varied in use by operation of the trigger.

2. A spray gun as claimed in claim 1, wherein said liquid flow control valve includes an annular member through which liquid flows in passing through said second inlet means, and a needle member coupled to said trigger for movement towards and away from the opening in said annular member to vary the flow of liquid into said second air passageway.

3. A spray gun as claimed in claim 1, wherein said air flow control valve includes an annular valve seat through which air normally flows in travelling along said first air passageway, a conical valve member, and a control rod mounting said valve member for movement towards and away from said seat for varying the volume of air flowing along said first air passageway, said control rod being coupled to the trigger of the gun.

4. A spray gun as claimed in claim 1, wherein said first inlet means is disposed in an upper portion of the body of the spray gun and includes means for supporting a container of particulate material so that said material can flow by gravity into said first air passageway.

5. A spray gun as claimed in claim 1 wherein said liquid flow control valve includes an annular member through which liquid flows in passing through said second inlet means, and a needle member coupled to said trigger for movement towards and away from the opening in said annular member to vary the flow of liquid into said second air passageway, and wherein said air flow control valve includes an annular valve seat through which air normally flows in travelling along said first air passageway, a conical valve member, and a control rod mounting said valve member for movement towards and away from said seat for varying the volume of air flowing along said first air passageway, said control rod being coupled to the trigger of the gun.

6. A spray gun as claimed in claims 5, wherein said liquid flow control valve and said air flow control valve are mounted on respectively opposite sides of said trigger, and wherein said needle member and said control rod are coupled directly to said trigger so that both valves are simultaneously opened as the trigger is squeezed.

7. A spray gun as claimed in claims 5, wherein said liquid flow control valve and said air flow control valve are mounted on respectively opposite sides of said trigger, and wherein said needle member and said control rod are coupled to said trigger so that both valves are simultaneously opened as the trigger is squeezed, wherein said control rod is coupled to said trigger by a abutment of the trigger against an outer end of the control rod, and wherein the spray gun further comprises means detachably coupling the needle valve of the liquid flow control valve to said trigger in either of first and second positions arranged so that, in said first position, the rest position of the trigger coincides with abutment of the control rod of the air flow control valve with the trigger, and in said second position, said trigger is spaced from said control rod in said rest position so that the air flow control valve remains closed and the gun can be used for spraying liquid only, said coupling means being detachable from the trigger so that the gun can alternatively be used for spraying particulate material only.

8. A spray gun as claimed in claims 5, wherein each of said needle member and said control rod is fitted with a compression spring normally biassing the associated valve to its closed position, said compression springs defining said spring means normally biassing the trigger to its rest position.

* * * * *